US010530061B2

(12) United States Patent
Chi et al.

(10) Patent No.: US 10,530,061 B2
(45) Date of Patent: Jan. 7, 2020

(54) MIXED MODE SLOT ANTENNAS

(71) Applicant: HEWLETT-PACKARD DEVELOPMENT COMPANY, L.P., Houston, TX (US)

(72) Inventors: David Chi, Taipei (TW); Pat Chen, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/746,095

(22) PCT Filed: Aug. 5, 2015

(86) PCT No.: PCT/US2015/043735
§ 371 (c)(1),
(2) Date: Jan. 19, 2018

(87) PCT Pub. No.: WO2017/023306
PCT Pub. Date: Feb. 9, 2017

(65) Prior Publication Data
US 2018/0219296 A1 Aug. 2, 2018

(51) Int. Cl.
*H01Q 13/10* (2006.01)
*H01Q 1/24* (2006.01)
(Continued)

(52) U.S. Cl.
CPC ..... *H01Q 13/10* (2013.01); *H01Q 1/243* (2013.01); *H01Q 1/38* (2013.01); *H01Q 5/30* (2015.01); *H01Q 1/2291* (2013.01)

(58) Field of Classification Search
CPC ..... H01Q 1/225; H01Q 1/2258; H01Q 13/10; H01Q 13/103; H01Q 13/106
See application file for complete search history.

(56) References Cited

U.S. PATENT DOCUMENTS 3,810,183 A 5/1974 Krutsinger et al.
4,710,775 A 12/1987 Coe
(Continued)

FOREIGN PATENT DOCUMENTS

CN 103811863 A 5/2014
TW M403119 5/2011

OTHER PUBLICATIONS

Hui Li, "Decoupling and Evaluation of Multiple Antenna Systems in Compact MIMO Terminals," Jun. 15, 2012, pp. 1-105, Universitetsservice US AB.

*Primary Examiner* — Daniel Munoz
(74) *Attorney, Agent, or Firm* — Lakshmi Kumaran & Sridharan (US LC)

(57) ABSTRACT

Example implementations relate to mixed mode slot antennas. Mixed mode slot antennas may be implemented in a display housing of a communication device. A mixed mode slot antenna unit may include a first PCB attached to a first metal layer to form a first mode antenna, where the first metal layer includes a first slot, and the first metal layer is a metal back cover of the display housing of the communication device. The mixed mode slot antenna unit may also include a second PCB coupled to the first PCB to form a second mode antenna, where the second metal layer includes a second slot, and where the second metal layer is a metal front cover of the display housing; and a non-conductive layer disposed between the first PCB and the second PCB to provide insulation between the first PCB and the second PCB.

15 Claims, 4 Drawing Sheets

(51) Int. Cl.

| | |
|---|---|
| ***H01Q 5/30*** | (2015.01) |
| ***H01Q 1/38*** | (2006.01) |
| *H01Q 1/22* | (2006.01) |

(56) References Cited

U.S. PATENT DOCUMENTS

| | | | | |
|---|---|---|---|---|
| 5,717,410 | A * | 2/1998 | Ohmine | H01Q 13/10 343/767 |
| 8,094,075 | B2 | 1/2012 | Cheng et al. | |
| 8,111,199 | B2 | 2/2012 | Baliarda et al. | |
| 8,493,274 | B2 * | 7/2013 | Raura | H01Q 1/243 343/702 |
| 2006/0097941 | A1 * | 5/2006 | Bettner | H01Q 9/14 343/767 |
| 2008/0231522 | A1 * | 9/2008 | Montgomery | H01Q 1/2258 343/702 |
| 2009/0102723 | A1 | 4/2009 | Mateychuk et al. | |
| 2011/0181476 | A1 | 7/2011 | Raappana et al. | |
| 2011/0300907 | A1 | 12/2011 | Hill et al. | |
| 2012/0162040 | A1 * | 6/2012 | Taura | G06F 1/1698 343/770 |
| 2014/0203974 | A1 | 7/2014 | Liu et al. | |
| 2014/0266945 | A1 | 9/2014 | Dou | |
| 2015/0116159 | A1 | 4/2015 | Chen et al. | |

* cited by examiner

MIXED MODE SLOT ANTENNAS

BACKGROUND

Communication devices include slot antennas for the purpose of communication. Such slot antennas generally include a long and slim slot, formed on a metal plate, to emit radio waves. Phones utilize the antenna for communication with radio access networks, while communication devices like laptops and tablets utilize the antenna for connecting to wireless networks like Wi-Fi. Design of communication devices are ever changing, and correspondingly, the design of the slot antennas also change with change in design of the communication devices.

BRIEF DESCRIPTION OF DRAWINGS

The detailed description is provided with reference to the accompanying figures. In the figures, the left-most digit(s) of a reference number identifies the figure in which the reference number first appears. The same numbers are used throughout the drawings to reference like features and components.

DETAILED DESCRIPTION

Figure 1:
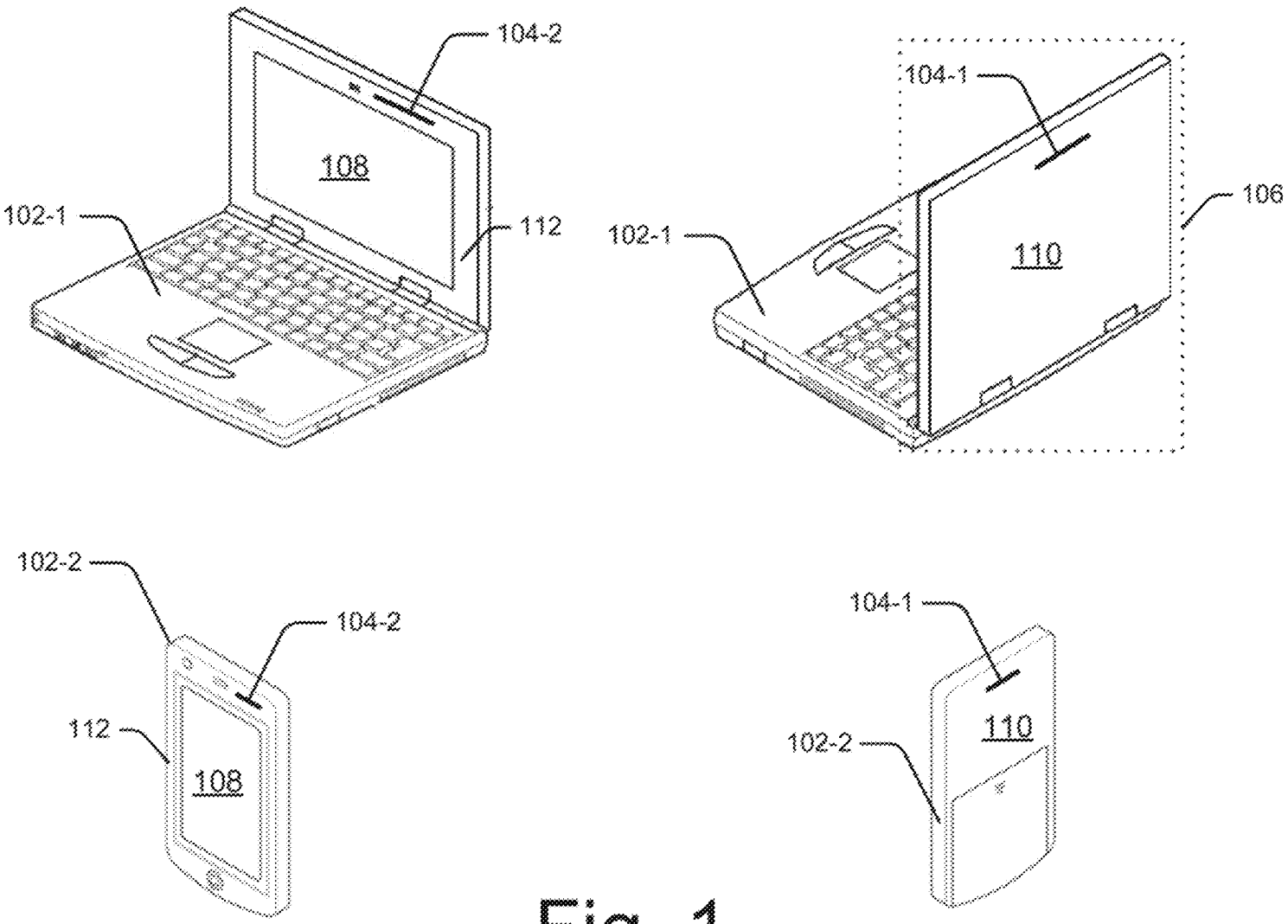
FIG. 1 illustrates examples of communication devices implementing mixed mode slot antenna, according to an example implementation of the present subject matter.

The present subject matter relates to mixed mode slot antennas for communication devices. A communication device generally comprises of a display such as a liquid crystal display (LCD) to project data for users. Such displays are generally housed in a housing which holds the display and provides support to different components of the display. For the sake of explanation, the housing is hereinafter referred to as display housing.

The display housing includes a front cover and a back cover. While the back cover is generally made of metal, and the front cover of the display housing is made of non-conductive material. Slots are created within the back cover to form a slot antenna to enable the communication device to communicate wirelessly.

In cases where the front cover of the display housing is also made of metal, the radiation efficiency of the slot antenna is drastically reduced due to blockade of the radiations by the metal front cover. In other words, due to interrupted radiations of the slot antenna, performance of the slot antenna is significantly degraded.

According to an example implementation of the present subject matter, a mixed mode slot antenna for communication devices is described. The described mixed mode slot antenna may allow optimum performance of slot antenna in communication device comprising display housing having metal front cover and metal back cover. On one hand the described techniques allow improved performance of the slot antenna in full metal designs of the display housing, on the other the described techniques provides dual mode antenna, capable of operating at different frequencies, thereby increasing flexibility of operation under different environment conditions.

In an example implementation of the present subject matter, a device may include a display and a mixed mode slot antenna unit housed within the display housing of the device. The display housing may include a metal front cover and a metal back cover, the example implantation, dual slots may be created, say a first slot and a second slot, one on each of the metal front cover and the metal back cover of the display housing of the device. The slots may be created such that each of the metal front cover and the metal back cover may act as a slot antenna operating at a predefined frequency. In an example, the metal back cover may include the first slot and the metal front cover may include the second slot.

The mixed mode slot antenna unit may include a first printed circuit board (PCB) and a second PCB, such that one PCB is attached with the metal front cover and the other PCB is attached to the metal back cover. For example, the first PCB may be attached to the metal back cover of the display housing and the second PCB may be attached to the metal front cover of the display housing.

In an example, the metal back cover including the first slot and attached to the first PCB may form a magnetic mode slot antenna. Similarly, the metal front cover including the second slot and attached to the second PCB may form an electric mode slot antenna. It would be noted that the magnetic mode slot antenna and the electric mode slot antenna may operate at different frequencies, depending upon the size, shape and location of first slot and the second slot.

In an example implementation of the present subject matter, the mixed mode slot antenna unit may include a non-conductive layer attached to the first PCB on one side and attached to the second PCB on the other side. In other words, the mixed mode slot antenna may include a non-conductive layer sandwiched between the first PCB layer and the second PCB layer. The non-conductive layer may provide insulation between the first PCB and the second PCB. Further, each PCB may include a feed line to excite corresponding metal front cover and the corresponding metal back cover of the display housing.

Accordingly, based on the implementation of the described techniques, a mixed mode slot antenna may be formed in the display housing of the device. The mixed mode slot antenna may provide flexibility of operation at different frequencies in different environmental conditions without any degradation in performance in all metal designs of the display housing.

The above techniques are further described with reference to FIG. 1 to FIG. 4. It should be noted that the description and the figures merely illustrate the principles of the present subject matter along with examples described herein and, should not be construed as a limitation to the present subject matter. It is thus understood that various arrangements may be devised that, although not explicitly described or shown herein, embody the principles of the present subject, matter. Moreover, all statements herein reciting principles, aspects, and implementations of the present subject matter, as well as specific examples thereof, are intended to encompass equivalents thereof.

FIG. 1 illustrates perspective views of communication devices 102-1 and 102-2, each including slots 104-1 and 104-2, according to an example of the present subject matter.

The communication devices 102-1 and 102-2 have been together referred to as communication devices 102, hereinafter. Similarly the slots 104-1 and 104-2 have been commonly referred to as slots 104, hereinafter.

Each communication device 102 may include a display housing 106 to support and hold a display 108 of the communication device 102. The display housing 106 may include a first metal layer 110 and a second metal layer 112. The communication device 102 may be a stationary device or a portable device. Further, the display housing 106 may include a mixed mode slot antenna unit (not shown), housed between the first metal layer 110 and the second metal layer 112.

The communication devices 102 may include, but are not restricted to, desktop computers, laptops, smart phones, personal digital assistants (PDAs), tablets, all-in-one computers, and the like. The slots 104 included within each communication device 102 may be of different dimension and may be located at different positions. For example, the first slot 104-1 may be included on the first metal layer 110; while the second slot 104-2 may be included on the second metal layer 112.

It would be noted that the slots 104 within each of the first metal layer 110 and the second metal layer 112 may allow the first metal layer 110 and the second metal layer 112 to act as slot antennas when excited by corresponding resonance frequencies. Further, since the length and width of the slot 104 may determine the resonance frequency of slot antenna, the length, and width of the slots 104 may vary depending on the desired frequency of operation. For example, to have the second metal layer 112 acting as an electric mode slot antenna and the first metal layer 110 as a magnetic mode slot antenna, the slot 104-2 may be larger in length than the slot 104-1.

The display housing 106 may surround the sides, partial front, and back surface of the display 108. The display housing 106 may be a metal housing including the metal front cover and the metal back cover. The display housing 106 may support the display 108 which may be implemented as a flat panel display, such as a liquid crystal display (LCD), a field emission display (FED), a plasma display panel (PDP), or an electroluminescence device (EL). The electroluminescence device comprises an organic light emitting display with organic light emitting diodes (OLED) formed in pixels.

Further, the display 108 may also include touch sensitive displays, such as resistive displays, capacitive displays, acoustic wave displays, infrared (IR) displays, strain gauge displays, optical displays, acoustic pulse recognition displays, and combinations thereof.

In an example implementation of the present subject matter, the first metal layer 110 may be the metal back cover of the display housing 106 and the second metal layer 112 may be the metal front cover of the display housing 106. It would be noted that in another example implementation, the first metal layer 110 may correspond to the metal front cover and the second metal layer 112 may correspond to the metal back cover.

The first metal layer 110 and the second metal layer 112, forming part of the display housing 106 may be made of metal capable of conducting and radiating electric and magnetic energy. In an example implementation, the first metal layer 110 and the second metal layer 112 may either be made of same metal, or may be made of different metals.

In an example implementation of the present subject matter, the first metal layer 110 and the second metal layer 112 may house the mixed mode slot antenna unit. The mixed mode slot antenna unit may include a couple of printed circuit boards (PCBs) to drive the first metal layer 110 and the second metal layer 112 as slot antennas.

The arrangement of the PCBs within the mixed mode slot antenna unit with respect to the display housing 106 has been further explained in reference to description of forthcoming figures.

Figure 2:
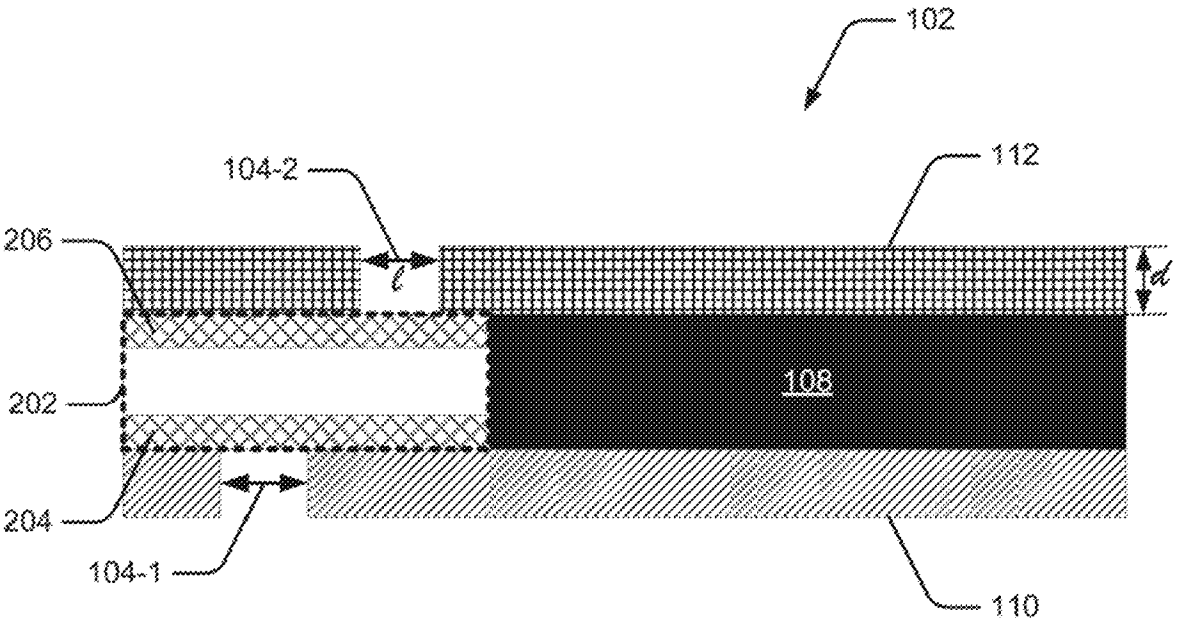
FIG. 2 illustrates a top view of arrangement of a mixed mode slot antenna unit implemented in a communication device, according to an example implementation of the present subject matter.

FIG. 2 represents a top view of an arrangement of the mixed mode slot antenna unit, in the communication device 102. The communication device 102 may include the first metal layer 110 and the second metal layer 112, to commonly house the display 108. In an example implementation of the present subject matter, the first metal layer 110 may represent the metal back cover of the display housing 106, and the second metal layer 112 may represent the metal front cover of the display housing 106. Further, the first metal layer 110 may be disposed on one side of the surface of the display 108, and the second metal layer 112 may be disposed on another side of the surface of the display 108.

In an example implementation of the present subject matter, first metal layer 110 may include the first slot 104-1 to allow the first metal layer 110 to act as a slot antenna. Similarly, the second metal layer 112 may include the second slot 104-2 to allow the second metal layer 112 to act as another slot antenna. As described earlier, the length (l) and width (not shown) of the slots 104 may determine the operating frequency of slot antennas, and therefore, the length and width of the slots 104 may vary depending on the desired frequency of operation.

For example, the slots 104 may be created such that the first metal layer 110 may act as a magnetic mode slot antenna, while the second metal layer 112 may act as an electric mode slot antenna. In said example, the first slot 104-1 may be of about 50 millimeters in length and 1.5 millimeters in width. In similar example, the second slot 104-2 may be of about 56 millimeters in length and 1.5 millimeters in width.

In another example, the slots 104 may be created such that the first metal layer 110 may act as electric mode slot antenna, while the second metal layer 112 may act as magnetic mode slot antenna. In such implementation, the first slot 104-1 may be of about 56 millimeters in length and 1.5 millimeters in width. Further, the second metal layer 112 may be of about 50 millimeters in length and 1.5 millimeters in width.

It would be noted that the depth (d) of each slot 104 may be of about the thickness of each of the first metal layer 110 and the second metal layer 112. Based on the design of the communication device 102, the depth (d) of each of the first metal layer 110 and the second metal layer 112 may vary. For example, the depth (d) of the first metal layer 110 may be equal to the depth (d) of the second metal layer 112. Correspondingly, the depth (d) of the first slot 104-1 may also be equal to the depth (d) of the second slot 104-2. In another example, the depth (d) of the first metal layer 110 may be different than the depth (d) of the second metal layer 112, and correspondingly, the depth (d) of the first slot 104-1 may be different than the depth (d) of the second slot 104-2.

In an example implementation of the present subject matter, the communication device 102 may include a mixed mode slot antenna unit 202, attached to the first metal layer 110 and the second metal layer 112. In the example, the mixed mode slot antenna unit 202 may be sandwiched between the first metal layer 110 and the second metal layer 112 such that mixed mode slot antenna unit 202 is housed within the display housing 106.

The mixed mode slot antenna unit 202 may include a first PCB 204 and a second PCB 206, such that the first PCB 204 is attached to the first slot 104-1 and the second PCB 206 is attached to the second slot 104-2. The PCBs may be composed of any suitable circuit board material, such as a di-electric material. By way of example, the PCBs could be composed of SR4 material. In other examples, the PCBs may be made of pre-impregnated materials, such as FR-2 (Phenolic cotton paper), FR-3 (Cotton paper and epoxy), and FR-4 (Woven glass and epoxy). Numerous variations of FR-4 may also be used, such as FR-408 and Polyclad 370HR. In an example implementation of the present subject matter, the first PCB 204 and the second PCB 206 may include printed feed lines to drive the slot antennas.

Figure 3:
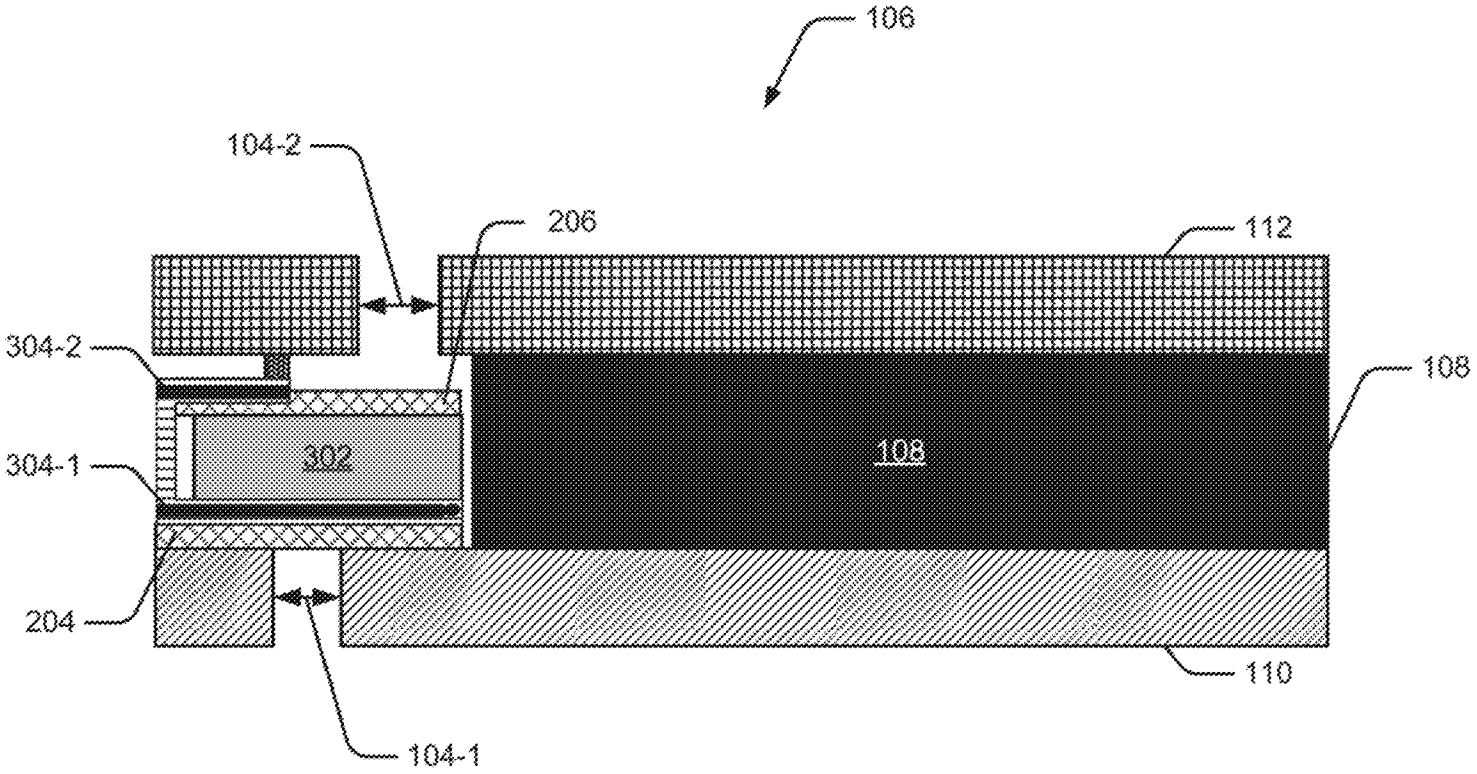
FIG. 3 illustrates a top view of various components of the mixed mode slot antenna unit implemented in a display housing, according to an example implementation of the present subject matter.

FIG. 3 represents another top view of arrangement of a mixed mode slot antenna unit 202 implemented in a display housing 106, according to an implementation of the present subject matter. The communication device 102 may include the first metal layer 110, the second metal layer 112, the display 108, and the mixed mode slot antenna unit 202.

In the above described implementation, the mixed mode slot antenna unit 202 may also include the first PCB 204 and the second PCB 206, along with a non-conductive layer 302. The non-conductive layer 302 may be sandwiched between the first PCB 204 and the second PCB 206 for insulation. It would be noted that the non-conductive layer 302 may include any material capable of being used for the purpose of insulation.

Further, the first PCB 204 may include a first printed feed line 304-1 and the second PCB 206 may include a second printed feed line 304-2. For the sake of explanation and clarity, the first printed feed line 304-1 and the second printed feed line 304-2 may be commonly referred to as printed feed lines 304, hereinafter. The printed feed lines 304 may drive each slot antenna at their respective operating frequencies. In an example implementation of the present subject matter, the printed feed lines 304 may be double sided flex printed circuit (FPC) feed lines such that a single printed feed line 304 is used to drive both slot antennas of the display housing 106.

In an example implementation of the present subject matter, the FPC feed line may extend from the first PCB 204 to the second PCB 206. In said implementation, the printed feed line may be attached to the first PCB 204 and the second PCB 206 by a fastener, such as a spring. It would be noted that though a spring has been mentioned to be utilized as a fastener, other fasteners may also be utilized based on implementation of the present subject matter.

Figure 4:
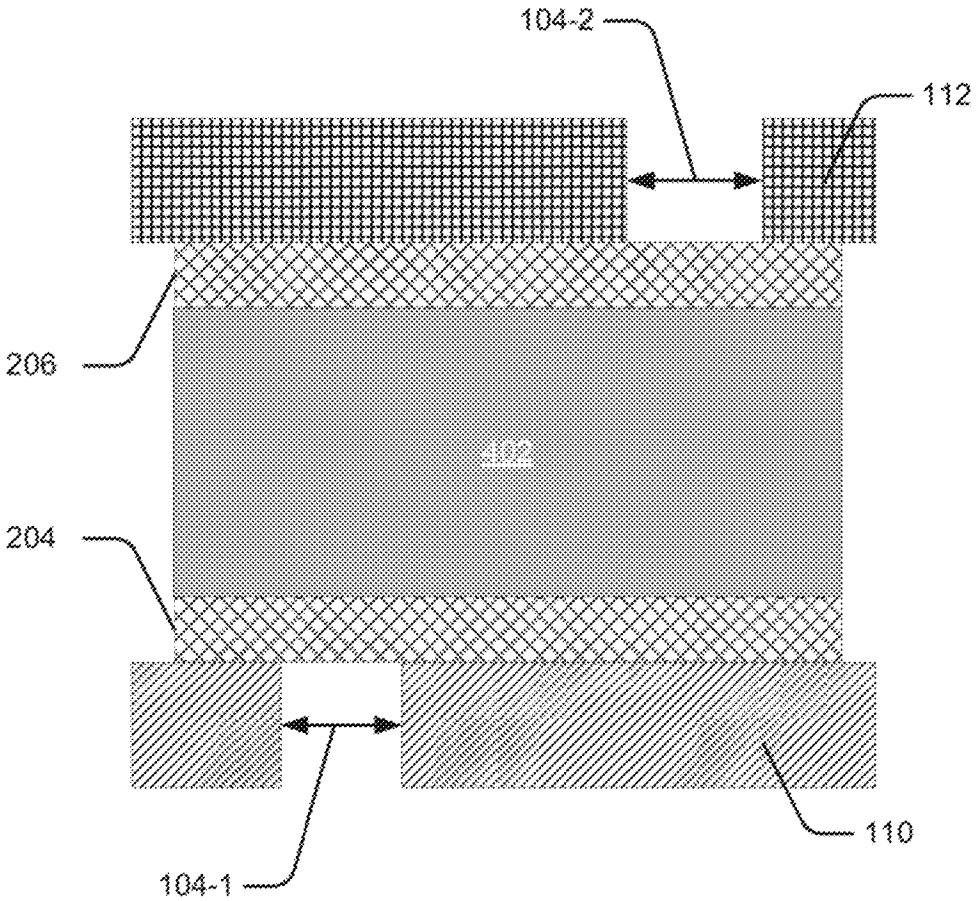
FIG. 4 illustrates an arrangement of the mixed mode slot antenna unit, according to an example implementation of the present subject matter.

FIG. 4 illustrates an arrangement of the mixed mode slot antenna unit 202, according to an example implementation of the present subject matter. The mixed mode slot antenna unit 202 may include the first metal layer 110 and the second metal layer 112 with the first slot 104-1 and the second slot 104-2, respectively.

The first slot 104-1 of the first metal layer 110 may be attached with the first PCB 204 to form a first mode antenna. Similarly, the second slot 104-2 of the second metal layer 112 may be attached to the second PCB 206 to form a second mode antenna. Further, the mixed mode slot antenna unit 202 may also include a non-conductive layer 402 between the first PCB 204 and the second PCB 206. It would be noted that the non-conductive layer 402 may be made of any non-conductive material, such as a dielectric to provide insulation between the first PCB 204 and the second PCB 206.

In an example implementation of the present subject matter, the mixed mode slot antenna unit 202 may also include ground points (not shown) disposed between the first metal layer 110 and the second metal layer 112 to. Further, the mixed mode slot antenna unit 202 may also include printed feed lines corresponding to each of the PCB to drive the first mode antenna and the second mode antenna.

Further, the first slot 104-1 of the first mode antenna may be of about 50 millimeters in length and 1.5 millimeters in width, such that the first mode antenna operates as a magnetic mode slot antenna. Furthermore, the second slot 104-2 of the second metal layer 112 may be of about 56 millimeters in length and 1.5 millimeters in width, such that the second mode antenna operates as an electric mode slot antenna.

In operation, the first mode antenna may be driven by a low band current flow to generate half wavelength slot radiations. For example, the first mode antenna may be driven by a frequency of about 2400 Mega Hertz (MHz) to 2500 MHz. Similarly, the second mode antenna may be driven by a high band current flow to generate short patch radiations. For example, the second mode antenna may be driven by a frequency of about 5100 MHz to 5900 MHz.

Therefore, the implementation of the mixed mode slot antenna unit with a dual slot design may provide flexibility of operation at different range of frequencies depending upon conditions of operation. Further, the presence of two slot antenna in the mixed mode slot antenna unit provides better performance even in all metal designs of display housing of communication devices.

Although implementations of present subject matter have been described in language specific to structural features and/or methods, it is to be understood that the present subject matter is not limited to the specific features or methods described. Rather, the specific features and methods are disclosed and explained in the context of a few implementations for the present subject matter.

What is claimed is:

1. A mixed mode slot antenna unit comprising:

a first PCB attached to, a first metal layer to form a first mode antenna, wherein the first metal layer includes a first slot, and wherein the first metal layer is a metal back cover of a display housing corresponding to a display;

a second PCB coupled to a second metal layer to form a second mode antenna, wherein the second metal layer includes a second slot, and wherein the second metal layer is a metal front cover of the display housing corresponding to the display; and a non-conductive layer disposed between the first PCB and the second PCB to provide insulation between the first PCB and the second PCB.

2. The mixed mode slot antenna unit as claimed in claim 1, wherein the first PCB includes a first printed feed line to drive the first mode antenna at a first frequency, and wherein the second PCB includes a second printed feed line to drive the second mode antenna at a second frequency.

3. The mixed mode slot antenna unit as claimed in claim 1 further comprising a fastener to fasten together the first PCB, the non-conductive layer, and the second PCB.

4. The mixed mode slot antenna unit as claimed in claim 1, wherein the first slot is about 50 millimeters in length and about 1.5 millimeters in breadth, and wherein the second slot is about 56 millimeters in length and about 1.5 millimeters in breadth.

5. A communication device comprising a mixed mode slot antenna unit for wireless communication, the communication device comprising:

a display;

a first metal layer disposed on one side of surface of the display, wherein the first metal layer comprises a first slot;

a first printed circuit board (PCB) attached to the first slot to forma magnetic mode slot antenna, wherein the magnetic mode slot antenna is driven by a first frequency;

a second metal layer disposed on another side of surface of the display, wherein the second metal layer comprises a second slot; and a second PCB attached to the second slot to form an electric mode slot antenna, wherein the electric mode slot antenna is driven by a second frequency.

6. The communication device as claimed in claim 5 further comprising a non-conductive layer disposed between the first PCB and the second PCB.

7. The communication device as claimed in claim 6 further comprising a fastener coupled to the second metal layer to fasten the second metal layer with the second PCB, the first PCB, the first metal layer, and the non-conductive layer.

8. The communication device as claimed in claim 5, wherein the first PCB includes a first printed feed line to drive the magnetic mode slot antenna with the first frequency.

9. The communication device as claimed in claim 5, wherein the second PCB includes a second printed feed line to drive the electric mode slot antenna with the second frequency.

10. The communication device as claimed in claim 5, wherein the first slot is about 50 millimeters in length and about 1.5 millimeters in breadth.

11. The communication device as claimed in claim 5, wherein the second is about 56 millimeters in length and about 1.5 millimeters in breadth.

12. The communication device as claimed in claim 5, wherein the first metal layer, the first PCB, the second metal layer, and the second PCB are substantially parallel to the surface of the display.

13. The communication device as claimed in claim 5, wherein the first metal layer is a metal back cover of a display housing corresponding to the display, and wherein the second metal layer is a metal front cover of the display housing.

14. A display housing comprising:

a metal back cover disposed on one side of surface of a display, herein the metal back cover includes a first slot;

a first PCB attached to the first slot to form a magnetic mode slot antenna, wherein the first PCB includes a first printed feed line to drive the magnetic mode slot antenna with a first frequency;

a metal front cover disposed on another side of the surface of h display, wherein the metal front cover includes a second slot;

a second PCB attached to the second slot to form an electric mode slot antenna, wherein the second PCB includes a second printed feed line to drive the electric mode slot antenna with a second frequency; and a non-conductive layer disposed between the first PCB and the second PC provide insulation between the first PCB and the second PCB.

15. The display housing as claimed in claim 14 further comprising a fastener coupled to the metal front cover to fasten the metal front cover with the second PCB, the first PCB, the metal back cover, and the non-conductive layer.

* * * * *